United States Patent [19]

Metz et al.

[11] 4,334,922

[45] Jun. 15, 1982

[54] PROCESS FOR METAL-BATH REFINING

[75] Inventors: Paul Metz, Luxembourg; François Schleimer, Esch; Lucien Lorang, Differdange; Ferdinand Goedert; Romain Henrion, both of Esch; Fernand Thill, Kockelscheuer, all of Luxembourg

[73] Assignee: ARBED S.A., Luxembourg, Luxembourg

[21] Appl. No.: 222,716

[22] Filed: Jan. 5, 1981

[30] Foreign Application Priority Data

Jan. 9, 1980 [LU] Luxembourg ..... 82070

[51] Int. Cl.[3] ..... C21C 5/30

[52] U.S. Cl. ..... 75/60; 75/59

[58] Field of Search ..... 75/60, 59

[56] References Cited

U.S. PATENT DOCUMENTS 3,649,246 3/1972 Fulton ..... 75/60

3,663,204 5/1972 Jungwirth ..... 75/60

3,871,871 3/1975 Denis ..... 75/60

*Primary Examiner*—P. D. Rosenberg

*Attorney, Agent, or Firm*—Karl F. Ross

[57] ABSTRACT

A ferrous metal in a vessel of a refining furnace in a steel-making plant is decarburized by injecting a main oxygen jet from a lance above the bath level into the melt through a supernatant slag layer and directing a secondary oxygen jet from that lance onto the bath surface for afterburning the carbon monoxide rising from the melt. At the same time, inert gas is blown through the melt from the bottom of the vessel to agitate the slag layer for the purpose of controlling its thickness and consistency. With continuous monitoring of the thickness of that layer, the rate of decarburization and the CO-afterburning factor (determined as the ratio of carbon dioxide to the sum of carbon monoxide and carbon dioxide released), the elevation of the lance above the bath level as well as the rate of oxygen emission and the rate of discharge of the agitating gas are controlled according to an empirically determined formula.

5 Claims, No Drawings

PROCESS FOR METAL-BATH REFINING

FIELD OF THE INVENTION

Our present invention relates to a process for refining, a ferrous melt by the top blowing of oxygen and the agitation of a slag layer by bottom-blown inert gas through the furnace hearth of a steel-making plant.

BACKGROUND OF THE INVENTION

To increase the productivity of the steel-making process, measures are required which on the one hand allow the inclusion in the bath of a maximum of iron-bearing material, such as scrap iron and/or rich ores, and on the other hand assures an improved quality by eliminating from the produced steel, as far as possible, phosphorus and sulphur contained in the charge.

It is known to monitor the evolution of the slag during the refining cycle and to adjust either the oxygen-lance blow rate or the height of the lance head above the level of the bath. In fact, the division of the blown oxygen between the slag and the molten metal can be, to a certain extent, adjusted by altering—with a steady oxygen-discharge rate and a particular lance-head configuration—the distance between the head of the lance and the bath level.

An increased height of the lance head results in the preferential oxidation of the slag which then assumes a frothy consistency, thus enhancing the dephosphorization and the desulphurization. On the other hand, a reduced height of the lance head leads to an accelerated decarburization and to an increased release of heat, principally at the oxygen-jet impact point, the heat of which can assist in the melting of the solid matter contained in the bath.

However, despite the development of expensive special lances with the aim to increase the extent of post-combustion or afterburning of CO at the bath surface, all imaginable efforts to increase the temperature at the bath surface with the intention to melt the remainder of the scrap are thwarted by the presence on the bath surface of a layer of thick and frothy slag which develops during the refining by top-blown oxygen and which acts as a thermal insulator because of its frothy consistency.

With these thoughts in mind, there has been developed a refining process which allows for an increase in the traditional levels of the scrap-iron additions and, at the same time, avoids the above-described disadvantages. That process, described in commonly owned Luxembourg patent application No. 81,207, provides for the refining of the bath by top-blown oxygen and, in the first place, promotes in the immediate proximity of the bath surface a post-combustion of carbon monoxide released during the decarburization by spreading the oxygen over that surface and, secondly, continually controls the thickness and the consistency of the slag by acting on the disequilibrium between the slag and the bath through the bottom-blown injection of an essentially inert gas, thereby enabling passage of the requisite amount of oxygen through the slag layer.

However, a refining process during which at all times the interface between the metal and the slag is continually swept by the addition of agitation gas, so that the slag remains always deoxidized and as a result cannot assume a frothy consistency, does not facilitate by itself the multiplicity of reactions which occur in the bath and especially in the slag.

In fact, the slag must necessarily have an adjustable level of reactivity as well as an essentially fluid consistency, equally adjustable, to allow the refining under conditions known to be favorable both from the point of view of afterburning of CO and from the point of view of the dephosphorization and desulphurization of the bath. At the same time, it is necessary to monitor the instantaneous level of decarburization of the bath as a function of the injected oxygen.

OBJECT OF THE INVENTION

Consequently, the object of our present invention is to provide a process of slag conditioning during the refining of a melt that allows the monitoring of the evolution of thermo-chemical reactions which occur in the bath and in the slag, as well as the monitoring of the behavior of the slag by making use on the one hand of fixed parameters, dependent on the configuration of the installation, and on the other hand of variable parameters of significance for the control of the thermo-chemical reactions occurring during refining.

SUMMARY OF THE INVENTION

We achieve this object, according to the present invention, by a refining process which relies essentially on top-blown oxygen emitted by a blow lance with a main and a secondary oxygen circuit which provides the oxygen necessary for the combustion of the CO released during the refining and which is accompanied by an agitation of the slag with an essentially inert gas blown through the bath from the furnace hearth or bottom of the refining vessel. This process is characterized in that, on the one hand, the thickness of the supernatant slag layer which covers the bath, the speed of decarburization of the bath as well as the carbon-monoxide afterburning are continuously monitored and that, on the other hand, the height of the blow lance above the bath, the total discharge rate of blown oxygen, the discharge rate of secondary oxygen used and the discharge rate of agitation gas used are adjusted in a way to satisfy, at any given time during the refining, the equation:

$$\left(\frac{HSC}{HB}\right)_t = K + a_1\left(\frac{HL}{DC}\right)^{\alpha 1} - a_2\left[\frac{DOT}{(1+x)DCDT}\right]^{\alpha 2}\cdot\left(1 - a_3\frac{DOS}{DOT}\right)^{\alpha 3} - a_4\left(\frac{F}{DOT}\right)^{\alpha 4}\cdot\left(1 - a_5\frac{DC}{HB}\right)^{\alpha 5}$$

where $(HSC/HB)_t$ is the ratio "slag thickness/height of the bath" at a given moment t;

HL is the height of the blow lance;

DC is the diameter of the vessel;

DOT is the total discharge rate of blown oxygen;

DCDT is the speed of decarburization of the bath;

X is the post-combustion or afterburning factor of the released CO, namely $\%CO_2/(\%CO+\%CO_2)$;

DOS is the discharge rate of secondary oxygen; and

F is the discharge rate of agitation gas, while K, $a_1$–$a_5$ and $\alpha_1$–$\alpha_5$ are the parameters which depend on the configuration of the steel-making plant and which are functions of the ratio: "total volume of oxygen introduced into slag/total volume of blown oxygen."

According to a more particular feature of our invention, the refining is conducted in a way to ensure that at any given time the ratio "slag thickness/bath height" remains between a lower limit and an upper limit determined in an empirical way for a given installation.

Once these limits are established, the dephosphorization and the desulphurization of the bath can be enhanced by adjusting the refining conditions in such a way as to shift the ratio "slag thickness/bath height" toward its upper limit, while the afterburning of the released CO can be enhanced by adjusting the refining conditions in a manner moving the ratio "slag thickness/bath height" toward its lower limit.

In practicing our invention the ratio "slag thickness/bath height" is determined. While the height of the bath remains constant, depending essentially on the quantity of pig iron and scrap steel in the bath, the thickness of the slag is subject to variation. To continuously monitor the slag thickness, we prefer to use the processes and measuring devices described in the commonly owned Luxembourg patent No. 71,261 and Luxembourg patent application No. 81,512.

These methods and devices lend themselves particularly well to integration into an overall computerized control system suitable for use within the framework of this invention. The same applies to the monitoring of the speed of decarburization (DCDT) by continual analysis of the converter's fumes with the help of a mass spectrometer and to the calculation of the CO-afterburning factor $\infty$ during refining.

In the ratio "lance height/furnace diameter" the height of the lance is obviously the only variable parameter. However, it is appropriate to point out that this ratio varies only slightly in the present context. In fact, while conventional refining processes attempt to control with more or less success the speed of decarburization of the bath by varying the discharge of blown oxygen, by adjustment of the height of the lance and selecting the lance heads so that with their help the oxygen-blowing angle can be chosen, the process according to the present invention allows the blow lance to be restricted practically to a role of a simple provider of oxygen, the speed of metal decarburization being regulated by adjustment of the discharge of the agitation gas.

As described above, a blow lance having a principal and a secondary oxygen circuit is used in order to clearly distinguish the jet of oxygen destined to penetrate into the bath from the secondary oxygen which is added for the purpose of maintaining the post-combustion of the CO on the surface of the bath.

The equation characterizing our invention takes into consideration the total oxygen discharge as well as the secondary-oxygen discharge in relation to the discharged amount of agitation gas.

EXAMPLE

Thus, for example, where in the steel foundry

HB=120 cm

DC=500 cm and a special afterburning blow lance is available, the equation may take the specific form $$HSC = 389 + 0.396HL^{1.324} - 229.35\left(1 - \frac{DOS}{DOT}\right)\left[\frac{DOT}{(1 + X)DCDT}\right]^{0.856} - 8{,}517.02\left(\frac{F}{DOT}\right)^{0.871}$$

where HSC and HL are expressed in cm, DOT, DOS and F in $Nm^3$/min,
and DCDT in kg/min.

Conducting the blow in accordance with this relationship and ensuring that HSC all the time remains between 120 and 200 cm, it was possible, beginning with an average pig-iron-ladle analysis:

C=3.90%
Mn=0.28%
P=1.65%
S=0.025%
Si=0.64%, to carry out refining in the converter so that P=0.010% and S=0.011% in the final analysis, with the following results:

Use of molten pig iron: 664 kg/t of steel
Use of scrap steel: 440 kg/t of steel
Iron output: 96.5%

It is obvious that the practice of the process according to this invention requires the use of a computer to which instruments measuring the inputs and outputs of flow meters and control valves for the gases are connected and which automatically conducts the refining operation.

We claim:

1. A process for refining a ferrous melt forming a metallic bath overlain by a supernatant slag layer in a vessel of diameter DC in a steel-making plant, comprising the steps of:

(a) positioning an oxygen lance above the bath;

(b) injecting a main oxygen jet from said lance through said slag layer into the bath for oxidizing carbon present in the melt;

(c) concurrently directing a secondary oxygen jet from said lance onto the bath surface for afterburning evolving carbon monoxide;

(d) concurrently blowing an inert gas from the bottom of said vessel through the bath for controlling the thickness and consistency of the slag layer in a manner enabling passage of a requisite amount of oxygen therethrough;

(e) continuously monitoring the thickness HSC of said slag layer with reference to bath height HB, the rate of decarburization DCDT of the melt and an afterburning factor X determined as the ratio of carbon dioxide to the sum of carbon monoxide and carbon dioxide released from the bath; and (f) adjusting, from time to time, the elevation HL of the lance above the bath level, the total rate DOT of oxygen emission from said lance, the flow rate DOS of the secondary oxygen jet and the discharge rate F of said inert gas to satisfy, substantially, the following equation for the time-varying ratio $(HSC/HB)_t$:

$$\left(\frac{HSC}{HB}\right)_t = K + a_1\left(\frac{HL}{DC}\right)^{\alpha 1} - a_2\left[\frac{DOT}{(1+X)DCDT}\right]^{\alpha 2}\cdot\left(1 - a_3\frac{DOS}{DOT}\right)^{\alpha 3} - a_4\left(\frac{F}{DOT}\right)^{\alpha 4}\cdot\left(1 - a_5\frac{DC}{HB}\right)^{\alpha 5}$$

wherein K, $a_1$, $a_2$, $a_3$, $a_4$, $a_5$, $\alpha_1$, $\alpha_2$, $\alpha_3$, $\alpha_4$ and $\alpha_5$ are parameters which are constant in a given steel-making plant operating with a predetermined ratio of total volume of oxygen introduced into the slag layer to the total volume of oxygen blown from the lance.

2. A process as defined in claim 9 wherein said ratio $(HSC/HB)_t$ is maintained between predetermined upper and lower limits.

3. A process as defined in claim 10 wherein said ratio $(HSC/HB)_t$ is held close to said upper limit for enhancing dephosphorization an desulphurization.

4. A process as defined in claim 10 wherein said ratio $(HSC/HB)_t$ is maintained close to said lower limit for enhancing the afterburning of the evolving carbon monoxide.

5. A process for refining a ferrous melt forming a metallic bath overlain by a supernatant slag layer in a vessel of a steel-making plant, comprising the steps of:

(a) positioning an oxygen lance above the bath;

(b) injecting a main oxygen jet from said lance through said slag layer into the bath for oxidizing carbon present in the melt;

(c) concurrently directing a secondary oxygen jet from said lance onto the bath surface for afterburning evolving carbon monoxide;

(d) concurrently blowing an inert gas from the bottom of said vessel through the bath for controlling the thickness and consistency of the slag layer in a manner enabling passage of a requisite amount of oxygen therethrough;

(e) continuously monitoring the thickness HSC of said slag layer, the rate of decarburization DCDT of the melt and an afterburning factor X determined as the ratio of carbon dioxide to the sum of carbon monoxide and carbon dioxide released from the bath; and (f) adjusting, from time to time, the elevation HL of the lance above the bath level, the total rate DOT of oxygen emission from said lance, the flow rate DOS of the secondary oxygen jet and the discharge rate F of said inert gas to satisfy, substantially, the following equation for a bath height of 120 cm and a vessel diameter of 500 cm:

$$HSC = 389 + 0.396HL^{1.324} - 229.35\left(1 - \frac{DOS}{DOT}\right)\left[\frac{DOT}{(1+X)DCDT}\right]^{0.856} - 8{,}517.02\left(\frac{F}{DOT}\right)^{0.871}.$$

* * * * *